US005141792A

United States Patent [19]

Kurtin

[11] Patent Number: 5,141,792

[45] Date of Patent: Aug. 25, 1992

[54] IMAGE TRANSFER LABEL FOR SOLVENT-SENSITIVE IMAGES

[76] Inventor: Stephen Kurtin, 3835 Kingswood Rd., Sherman Oaks, Calif. 91403

[21] Appl. No.: 580,174

[22] Filed: Sep. 10, 1990

Related U.S. Application Data

[63] Continuation-in-part of Ser. No. 352,126, May 15, 1989, Pat. No. 5,030,492, and a continuation-in-part of Ser. No. 463,419, Jan. 11, 1990, abandoned.

[51] Int. Cl.[5] ..... B41M 5/00

[52] U.S. Cl. ..... 428/41; 40/299; 428/81; 428/194; 428/195; 428/321.5; 428/352; 428/914

[58] Field of Search ..... 428/195, 207, 321.5, 428/913, 914, 40, 41, 81, 194, 352; 503/200, 215, 213; 40/299

[56] References Cited

U.S. PATENT DOCUMENTS 4,654,256 3/1987 Doree et al. ..... 428/304.4

*Primary Examiner*—Bruce H. Hess

*Attorney, Agent, or Firm*—Saul Epstein

[57] ABSTRACT

A label for replicating images which includes an image-receiving sheet having microencapsulated solvent embedded therein. The image-receiving sheet is removably bonded to a base film which permits the label to be easily handled. Applying pressure to the label when it is in contact with a solvent-sensitive image (such as a xerographically produced page) causes the microcapsules to break and a small part of the image to dissolve and deposit on the image-receiving sheet. The image-receiving sheet (after receiving the dissolved portion of the image) is attached to a destination surface (preferably by a self-adhesive) and the base film peeled off.

10 Claims, 1 Drawing Sheet

IMAGE TRANSFER LABEL FOR SOLVENT-SENSITIVE IMAGES

RELATED APPLICATIONS

This is a continuation-in-part of application Ser. Nos. 352,126, filed May 15, 1989, now U.S. Pat. No. 5,030,492 and 463,419 filed Jan. 11, 1990, now abandoned.

BACKGROUND OF THE INVENTION

The problem of addressing envelopes in the course of creating ordinary business correspondence while using shared laser printers was addressed in previous patent applications by the present inventor, namely in U.S. Pat. No. 4,900,597, and in application Ser. Nos. 352,126 and 463,419. Several means were disclosed in these previous applications for reproducing on a second surface (such as an envelope), a solvent-sensitive image which appears on a first surface (such as an address on a xerographically produced letter). The reproduction as disclosed in the previous applications was accomplished by replicating an original solvent-sensitive image on the underside of a transparent label. The label with the replicated image was then attached to a destination surface (e.g., the face of the envelope). All of the systems disclosed involve a label comprised of a plastic base film to which an image-receiving coating is applied. To reproduce an image, the image-receiving coating is put in contact with the image to be reproduced, and the interface wet with a solvent. A small part of the pigment and binder making up the image dissolves and is deposited on the image-receiving coating, creating a replica of the original image. Since only a small part of the material of the original image is dissolved, the original image remains, virtually unharmed. The label, with the replicated image on its under surface, is then attached to any desired destination surface.

Several ways of applying the solvent to the interface between the original image and the image-receiving coating were disclosed. In one embodiment, the solvent is microencapsulated and is dispersed on the plastic base film, embedded in the image-receiving coating. In use, the coating is placed in contact with the image to be reproduced and pressure applied to break the solvent-laden microcapsules. The escaping solvent then wets the interface between the original image and the image-receiving coating. A replica of the original image on the image-receiving coating is thereby formed as described above. The final label, as it is attached to a destination surface, consists of the plastic base film with the image-bearing coating attached.

SUMMARY OF THE INVENTION

The label of the present invention is similar in many respects to the label described in the previous section of this application. In the present invention, however, the final label, as attached to the destination surface, does not include the plastic base film. Instead of the plastic base film being adhered to the destination surface, it is separated from the image-bearing coating, and the coating alone is attached to the destination surface. The plastic base film is then discarded. The separation is preferably accomplished after the coating is attached to the destination surface, but it could be done at a prior time. A second embodiment of the present invention involves no base film at all. In this embodiment the image-receiving "coating" (with solvent laden microcapsules embedded) is produced as a separate sheet of material without a base film support.

In the previously disclosed inventions, the physical requirements of the image-receiving coating (in which the solvent laden microcapsules are embedded) are relatively loose. In addition to its adhering qualities, it is necessary that the coating not be so soluble in the solvent used that a gooey mess is created when the microcapsules are broken. In the present invention, since there is no plastic base film to protect the coating after it is in place on the destination surface, the coating layer itself must be physically robust enough to withstand whatever handling or other rough usage may be encountered in the particular application. An advantage of the present invention, as compared to the previously disclosed labels, is that since there is less material between the reproduced image and the eye after the label is attached to the destination surface, the image appears sharper. The second embodiment of the invention, which involves no base sheet, will also cost less to manufacture.

A better and more complete understanding of the invention can be had by reference to the below detailed description, and the attached drawings.

DETAILED DESCRIPTION OF THE INVENTION

Figure 1:
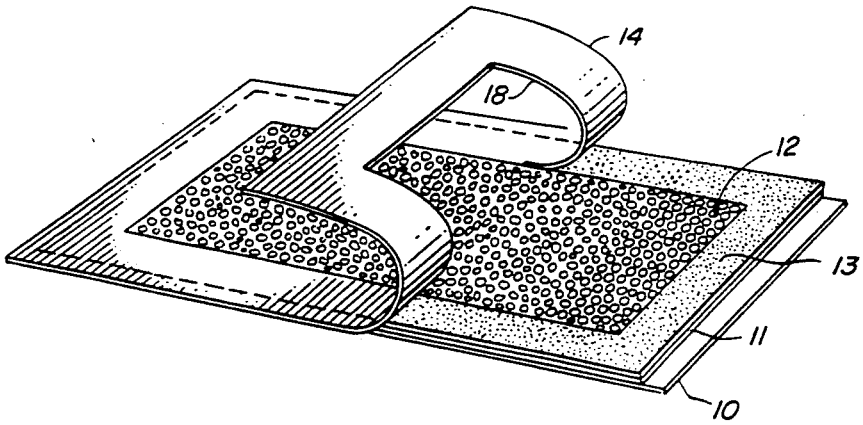
FIG. 1 is an oblique view of an image transfer label according to the present invention. In order to clearly show the various parts of the label, the underside of the label is shown facing up and the protective release liner 14 is shown partially peeled off.

The invented image transfer label, as seen in FIG. 1, is formed on a base film 10 which may be, for example, a polyester film. As will be discussed below, this base film is eventually discarded, and does not form a part of the final image bearing structure on the destination surface. The base film 10, which is preferably transparent to allow the image transfer process to be monitored visually, is coated with a layer comprised of a binder 11 in which solvent-laden microcapsules 12 are embedded. For reference purposes it may be noted that the elements in the parent applications which performed substantially similar functions as binder 11 were called "coatings". There are a number of materials which are suitable for use as the binder, for example, polyvinyl alcohol cross linked with glyxol. A thickness of about one mil has been found to be suitable. Since the binder will eventually be removed from the base film and be unprotected, it should have adequate physical characteristics to withstand whatever environmental hazards which might be encountered in the particular use intended. The binder and the base film should bond with sufficient strength that the label can be handled, and the image transfer process accomplished; the bond should not be so strong, however, that the base film cannot be peeled off after the image bearing binder layer is adhered to the destination surface. The solvent should be non-toxic, volatile, and solvate the substance forming the image to be reproduced.

A border layer 13 of self-adhesive (commonly known as "pressure-sensitive adhesive"), used to retain the label to the destination surface, covers the binder coating around its periphery. The adhesive is preferably of the permanent type so that there is little probability of the label being detached from the destination surface during subsequent handling. If desired, a light coating of a removable type of self-adhesive can be formed over the central portion of the binder coating. A removable adhesive in the central region will not interfere with the image transfer process, but can serve to attach the central portion of the label to the destination surface so that the label will not have a tendency to ripple.

A release liner 14 is used to protect the adhesive layer 13 prior to use, and to allow the label to be conveniently handled. The release liner is peeled off the label just prior to its being attached to the destination surface. Release liner technology is well known in the label art, and need not be described here in detail.

Figure 2:
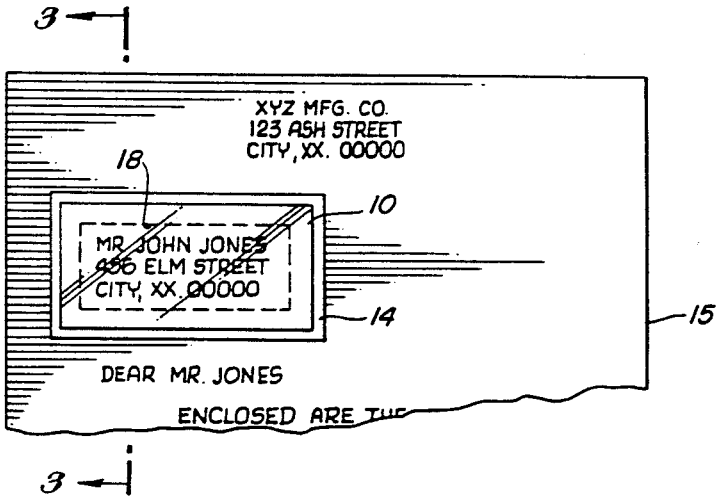
FIG. 2 is a plan view of the label of FIG. 1 in place over an address on a donor sheet
Figure 3:
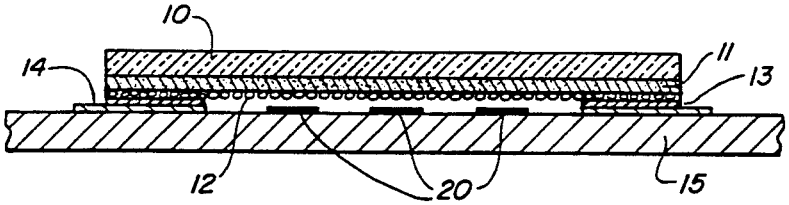
FIG. 3 is a cross sectional view of the image transfer label of FIG. 2. The view is taken at 3—3 of FIG. 2. It should be noted that for illustrative purposes the microcapsules 12 are shown as being on the surface of binder layer 11. In an actual label, the microcapsules would be embedded in the binder.

To address an envelope in accordance with the principles of the present invention, a donor sheet containing the address is used (e.g., donor sheet 15 as seen in FIGS. 2 and 3). Either an original laser printed letter or a xerographically reproduced copy can be used as the donor sheet. Both are xerographic processes which result in solvent-sensitive fused toner images. There may be some degradation of the address on the donor sheet on account of the transfer process, particularly if care is not used, and it may therefore be preferred to use an eventual file copy of the letter as the donor. The degradation is typically minor, however, and in many cases the letter to be sent could actually be used as the donor.

The first step in the transfer process is to position the label over the address to be transferred on donor sheet 15, as shown in FIGS. 2 and 3. The dark lines 20 on sheet 15 which can be seen in FIG. 3 represent the fused toner letters on the donor sheet, and the dotted line 18 on FIG. 2 represents the periphery of the opening in release liner 14. The top surface of the base film 10 is then rubbed with a fingernail, a paper clip, or some other hard instrument (while the donor sheet is supported on a hard surface such as a table). The rubbing ruptures the microcapsules, releasing the stored solvent. The solvent then wets the fused toner, and some of it goes into solution. Since the solution is in contact with the capsule shells and the binder, the area of the binder which is directly adjacent to the fused toner turns dark. The solvent, being volatile, evaporates rapidly leaving a permanent replica of the original image on the binder.

Figure 4:
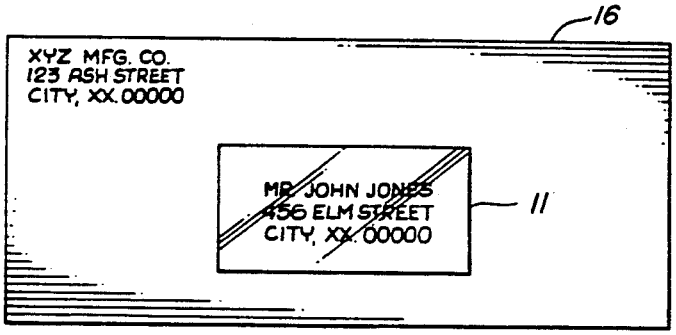
FIG. 4 is a plan view of an envelope after an address has been transferred to the envelope according to the present invention.

The label assembly is then lifted from the donor sheet, and release liner 14 removed. The label may then be positioned on a destination surface such as envelope 16 shown in FIG. 4. The exposed adhesive 13 around the periphery of the label permanently attaches the label to the envelope. The removable adhesive in the central portion of the label, if present, adheres to the envelope, keeping the label from rippling. Base film 10 can then be peeled from the label and discarded.

If desired, the label can be made without the use of a base film (i.e., base film 10). The binder 11, with the microencapsulated solvent embedded therein can be made sufficiently strong and robust that a base film is not needed. The structure in this case would be comprised of the binder 11 with the microencapsulated solvent embedded, the layer 13 of self adhesive, and the release liner 14. The process of transferring an image would be as described except that the step of peeling off the base film would not be necessary.

There are a number of possible formulations for the microencapsulated solvent system, the presently preferred one being 1,1,1-trichloroethane encapsulated in gelatin based microcapsules. This solvent is relatively non-toxic, is volatile, and a good solvent for fused toner. The addition of small amounts of amyl acetate imparts a pleasant odor to the solvent and reduces its vapor pressure.

The size of the microcapsules is important if good results are to be obtained. If the microcapsules are too small, it is difficult to break them using reasonable pressure. Also, an insufficient amount of solvent may be released to dissolve an adequate amount of toner. On the other hand, if the microcapsules are too large, too much solvent will be released, and smearing of the image results. The optimum size for the capsules appears to be in the about 30 to about 500 micron diameter range. Generally, the lower end of the range quoted produces the best results, but the optimum amount of solvent needed to transfer particular images may involve larger or smaller microcapsules. It is preferable that the capsule shells be transparent and colorless so that when in place the label will take on the color of the envelope and be unobtrusive.

While the foregoing describes the invention according to the presently preferred embodiments thereof, persons skilled in the art will no doubt be enabled to make variious adaptations and modifications of the invention which adaptations and modifications are intended to fall within the spirit of the following claims.

I claim:

1. A label for replicating a solvent-sensitive image which comprises:

a transparent image-receiving sheet; and microencapsulated solvent embedded in said sheet.

2. A label for replicating a solvent-sensitive image as recited in claim 1 and further including means for attaching said image-receiving sheet to a surface.

3. A label for replicating a solvent-sensitive image as recited in claim 2 where said means for attaching said sheet to a surface comprises a layer of pressure-sensitive adhesive around the periphery of said sheet.

4. A label for replicating a solvent-sensitive image as recited in claim 3 and further including a release liner covering said layer of pressure-sensitive adhesive.

5. A label for replicating a solvent-sensitive image as recited in claim 1 where said solvent is 1,1,1-trichloroethane.

6. A label for replicating a solvent-sensitive image which comprises:

a base film;

a transparent image-receiving coating on said base film, said base film; and microencapsulated solvent embedded in said image-receiving coating.

7. A label for replicating a solvent-sensitive image as recited in claim 6 and further including means for attaching said image-receiving coating to a surface.

8. A label for replicating a solvent-sensitive image as recited in claim 7 where said means for attaching said image-receiving coating to a surface comprises a layer of pressure-sensitive adhesive around the periphery of said coating.

9. A label for replicating a solvent-sensitive image as recited in claim 8 and further including a release liner covering said layer of pressure-sensitive adhesive.

10. A label for replicating a solvent-sensitive image as recited in claim 6 where said solvent is 1,1,1-trichloroethane.

* * * * *